US010904980B2

(12) United States Patent
Schenk et al.

(10) Patent No.: US 10,904,980 B2
(45) Date of Patent: Jan. 26, 2021

(54) ADAPTIVE MODULATION AND DATA EMBEDDING IN LIGHT FOR ADVANCED LIGHTING CONTROL

(71) Applicant: SIGNIFY HOLDING B.V., Eindhoven (NL)

(72) Inventors: Tim Corneel Wilhelmus Schenk, Eindhoven (NL); Lorenzo Feri, Eindhoven (NL); Hongming Yang, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 755 days.

(21) Appl. No.: 13/676,379

(22) Filed: Nov. 14, 2012

(65) Prior Publication Data

US 2013/0069540 A1 Mar. 21, 2013

Related U.S. Application Data

(63) Continuation of application No. 12/866,039, filed as application No. PCT/IB2009/050520 on Feb. 9, 2009, now Pat. No. 8,330,379.

(30) Foreign Application Priority Data

Feb. 12, 2008 (EP) ..... 08151318

(51) Int. Cl.
*H05B 47/10* (2020.01)
*H05B 45/10* (2020.01)

(52) U.S. Cl.
CPC ..... *H05B 47/10* (2020.01); *H05B 45/10* (2020.01)

(58) Field of Classification Search
CPC ... H05B 33/0869; H05B 17/30; H05B 10/808
(Continued)

(56) References Cited

U.S. PATENT DOCUMENTS 771,917 A * 10/1904 De Moura ..... 398/132
2,494,645 A * 1/1950 Collins ..... 398/129
(Continued)

FOREIGN PATENT DOCUMENTS

EP 1566311 A2 8/2005
JP 06077962 A 3/1994
(Continued)

OTHER PUBLICATIONS

TAOS TCS230 Programmable Color Light-to-Frequency Converter, TAO046, Feb. 2003.*
(Continued)

*Primary Examiner* — Christine M Behncke
*Assistant Examiner* — Christine Johnson
(74) *Attorney, Agent, or Firm* — Meenakshy Chakravorty

(57) ABSTRACT

Disclosed is a method for controlling a light output signal emitted by a set of light sources comprising at least one light source, wherein said light output signal includes a modulation signal which carries individual information, such that the method includes recurrently:

remotely detecting the light output signal of said set of light sources;

determining at least one quality measure of said remote detection of the light output signal; and adjusting the modulation signal on basis of said at least one quality measure.

11 Claims, 3 Drawing Sheets

(58) Field of Classification Search
USPC ..... 398/132
See application file for complete search history.

(56) References Cited

U.S. PATENT DOCUMENTS

| | | | | |
|---|---|---|---|---|
| 3,493,956 | A * | 2/1970 | Andrews et al. | 345/56 |
| 3,796,831 | A * | 3/1974 | Bauer | 375/238 |
| 5,311,300 | A * | 5/1994 | Blankevoort et al. | 348/690 |
| 5,412,686 | A * | 5/1995 | Ling | H04B 17/327 375/147 |
| 6,049,171 | A * | 4/2000 | Stam et al. | 315/82 |
| 6,272,322 | B1 * | 8/2001 | Su | H04B 17/309 455/67.14 |
| 7,145,966 | B2 * | 12/2006 | Lai | H04L 27/22 375/227 |
| 7,190,741 | B1 * | 3/2007 | Manning | H04B 1/1027 375/227 |
| 2006/0006821 | A1 * | 1/2006 | Singer et al. | 315/312 |
| 2006/0071613 | A1 | 4/2006 | Lovato et al. | |
| 2006/0239689 | A1 | 10/2006 | Ashdown | |
| 2006/0245174 | A1 * | 11/2006 | Ashdown et al. | 362/85 |
| 2007/0035706 | A1 * | 2/2007 | Margulis | 353/122 |
| 2007/0216638 | A1 * | 9/2007 | Kojima | 345/102 |
| 2008/0185969 | A1 | 8/2008 | Vegter et al. | |
| 2009/0184648 | A1 | 7/2009 | Colak et al. | |
| 2009/0196613 | A1 * | 8/2009 | Linnartz | H04B 10/11 398/78 |

FOREIGN PATENT DOCUMENTS

| | | | | |
|---|---|---|---|---|
| WO | 0225842 | A2 | 3/2002 | |
| WO | 2004057927 | A1 | 7/2004 | |
| WO | 2006111927 | A1 | 10/2006 | |
| WO | 2006111930 | A2 | 10/2006 | |
| WO | 2006111934 | A1 | 10/2006 | |
| WO | 2007121574 | A1 | 11/2007 | |
| WO | 2008001262 | A1 | 1/2008 | |
| WO | WO2008001262 | * | 1/2008 | H04B 10/10 |
| WO | WO 2008001262 | A1 * | 1/2008 | H04B 10/11 |

OTHER PUBLICATIONS

Sugiyama et al: "Brightness Control Methods for Illumination and Visible-Light Communication Systems"; Proceedings of the Third International Conference on Wireless and Mobile Communications (ICWMC'07), IEEE 2007, 6 Page Document.

Linnartz et al: "Communications and Sensing of Illumination Contributions in a Power LED Lighting System"; IEEE International Conference on Communications, 2008, ICC'08, May 2008, pp. 5396-5400.

Hidemitsu Sugiyama et al, "Brightness Control Methods for Illumination and Visible-Light Communication Systems", IEEE, Proceedings of the Third International Conference on Wireless and Mobile Communications, 0-7695-2796-5/07,2007.

* cited by examiner

ADAPTIVE MODULATION AND DATA EMBEDDING IN LIGHT FOR ADVANCED LIGHTING CONTROL

FIELD OF THE INVENTION

The present invention relates to a method for controlling the light output of a set of light sources comprising at least one light source, wherein a light output signal of the set of light sources is modulated by a modulation signal comprising individual information. Further, the present invention relates to a lighting system comprising a detector device and a master controller, which are arranged to control the light output in accordance with the method.

BACKGROUND OF THE INVENTION

In order to allow advanced control of a lighting system, devices and methods have been developed where the light output of each light source is modulated by a modulation signal. The modulation signal comprises individual information, such as an identification code or data regarding light source properties, etc. By thus providing each light output signal with such individual information it is possible to for instance remotely check the status of the light sources, or to facilitate the identifying of the contribution from each light source to an overall light output that is remotely detected, i.e. detected at a distance from the light sources.

One such lighting system that is known in the prior art is disclosed in WO 2006/111927, where the light intensity of different light sources is individually controlled. The lighting system comprises a plurality of light sources, a detector device, and a master controller. Each light source is driven by a drive signal, which comprises a power signal, and a modulation signal, which modulates the power signal. The modulation signal carries the information content, while the power signal provides the basic power that determines the light intensity of the light source. The overall light output is remotely detected, by means of the detector device, and the individual contributions from the respective light sources are identified by means of individual modulation signals, which comprise identification information. Further, each modulation signal comprises additional data, such as status information, about the associated light source. A light property, such as intensity, of each light source is estimated. The information thus obtained is sent to the master controller, which determines any necessary adjustments of the light outputs of the light sources. Adjustment data is sent to the drive devices of the light sources for adjusting said power signals.

The known control method and control device of WO2006/111927, as well as other similar methods and devices, are independent of the actual configuration of the lighting system. They are not optimum for a given setup of different light sources. Typically, different light sources have a different distance to the detector, have a different light intensity, and have a different orientation with respect to the detector. Still it is desired to achieve a high reliability in detection of the individual information as well as the light property, even for a large number of light sources. In the prior art concepts this would only be possible by designing for the light source with the worst case performance. That inherently decreases the dimming range, i.e. the range between the lowest possible and the highest possible intensity of the light output, and data rate of the lighting system to an unnecessarily high extent. It should be noted that the dimming range is affected by the power that is used by the very modulation signal.

SUMMARY OF THE INVENTION

It is an object of the present invention to provide a control method and device that alleviates the above-mentioned drawbacks of the prior art and provides conditions for optimizing the performance of the system.

In accordance with various embodiments of the present invention this object is achieved by a method for controlling the light output signal of a set of light sources, and a control system including a detector device and a master controller, which are arranged to control the light output signal of a set of light sources, as disclosed and claimed herein.

The invention is based on an insight that the light output control is dependent on the quality, such as reliability, of the measurements performed at the detector, and that by adjusting properties of the very modulation signal it is possible to obtain a good quality while undesirably affecting the overall light properties to a lowest possible extent.

Thus, in accordance with an aspect of the present invention, there is provided a method for controlling a light output signal emitted by a set of light sources comprising at least one light source, wherein said light output signal comprises a modulation signal which carries individual information, the method including recurrently:

- remotely detecting the light output signal of said set of light sources;
- determining at least one quality measure of said remote detection of the light output signal; and
- adjusting the modulation signal on basis of said at least one quality measure.

In accordance with another aspect of the invention, there is provided a system for controlling a light output signal emitted by a set of light sources comprising at least one light source, wherein said light output signal comprises a modulation signal, which carries individual information, the system including:

- a remote detector device;
- a master controller, arranged to receive detected data from the detector device; and
- a set of light source drive units, arranged to receive control data from said master controller, wherein each one of said drive units is connected to a respective one of said light sources;

wherein:

- said remote detector device is arranged to detect the light output signal of said set of light sources; and
- said master controller is arranged to determine at least one quality measure of said detection; and
- generate a control signal for said set of light source drive units, said control signal carrying, if necessary, an adjustment of the modulation signal, on basis of said at least one quality measure.

Thus, according to various embodiments of the present invention, in order to obtain or keep a desired reliability in the detection of the light output signal, the modulation signal as such is adjusted, if an adjustment of the reliability is necessary. By using the modulation signal as a moderator rather than just adjusting the power signal as in prior art, it is easier to modify the reliability without adversely affecting light properties. Here it should be noted that adjusting the reliability might mean either increasing or decreasing it. For instance, the latter can be of interest in order not to overcompensate for deficiencies at the expense of a decreased dimming range. Further, in some applications one is only interested in capturing the information carried by the modulation signal. Furthermore, when trying to improve the reliability of detecting the information, adjusting merely the power signal will sometimes render no or little effect. The present method and control system provide an opportunity to keep the dimming range as large as possible while achieving reasonable conditions for the detection and control. The set of light sources can be one or several light sources. In the latter case typically the same drive signal is fed to all light sources, which emit light comprising a common individual information.

In accordance with one embodiment of the method, the step of determining a quality measure comprises:

estimating at least one performance parameter for the transmission link extending between the set of light sources and the position where the remote detection takes place; and using said at least one performance parameter for said determining at least one quality measure.

This embodiment advantageously takes into count the conditions on the transmission link, i.e. the environment where the light transmission and the detection takes place.

In accordance with another embodiment of the method, said at least one quality measure comprise at least one of signal-to-noise ratio, signal amplitude of the detected individual light output signal, and noise level of the detected individual light output signal. These are typical examples of attractive parameters for making a good determination of the quality measure.

In accordance with yet another embodiment of the method, said step of adjusting the modulation signal comprises adjusting at least one of modulation depth, frequency, and intensity of the modulation signal. These are examples of appropriate signal properties to adjust in order to obtain a good effect. Modulation depth is advantageous in some different modulation techniques, such as PWM (Pulse Width Modulation), and so is the intensity, which typically is adjusted by adjusting the amplitude of the modulation signal.

In accordance with still embodiment of the method, said step of determining a quality measure comprises:

determining a present level of quality; and comparing the present level of quality with a desired level of quality.

This is an advantageous way of providing a useful quality measure, which additionally opens up for possible user influence by letting the desired level of quality be user settable.

In accordance with yet another embodiment of the method, said step of remotely detecting the light output signal comprises extracting said individual information from the light output signal; and wherein said step of determining at least one quality measure comprises determining a quality measure of said extraction of individual information. Thus, this embodiment focuses in particular on how the detection manages to extract the information carried by the modulation signal.

In some embodiments, the individual information is represented as one or more bits within each time period, such as the duty cycle, of the light output signal. Then the quality measure can be chosen to be related to the number of incorrectly detected bits, for example during a predetermined time period, or as a ratio of incorrectly to correctly detected bits. This provides for an option to have the step of adjusting the modulation signal comprise adjusting the number of bits within the time period.

In accordance with one embodiment of the method, it is emphasized that the scope of detecting involves estimating at least one light property of the light output signal, and that the scope of determining at least one quality measure involves determining a quality measure of said estimation. Thus, the estimation of one or more light properties, which is known per se, can be a part of this method as well.

In accordance with yet another embodiment of the method, it is defined that the output light signal in addition to the modulation signal comprises a power signal, which is adjusted as well. This adjustment can be a part of securing a correct level of reliability, and/or avoiding displacement of the color point of the light output signal, or a decrease in dimming range, which in turn may involve basing the power signal adjustment also on the adjustment of the modulation signal.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1:
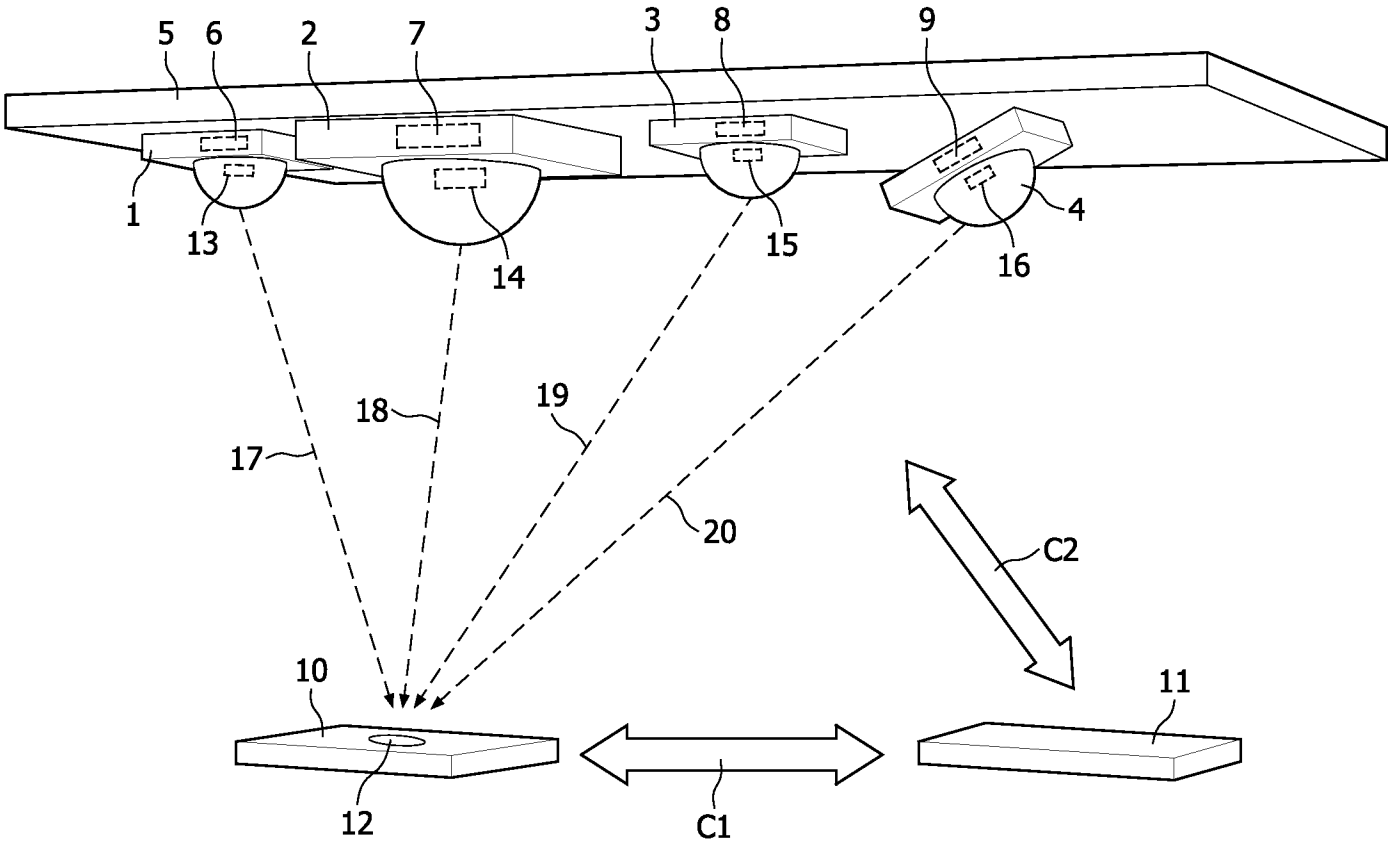
FIG. 1 schematically illustrates a lighting system comprising a control system according to an embodiment of the control system of the present invention.

Referring to FIG. 1 an exemplifying lighting system comprises four sets of light sources 1-4, which are mounted at the ceiling 5 of a structure, such as a room in a building. Each set consists of a single light source. The light sources 1-4 can be of any type which is dimmable and which offers the ability of being modulated in the way described herein. Typical examples of types are LED light sources, fluorescent lamps, high intensity discharge lamps, incandescent lamps and halogen lamps. They can be white or colored. For reasons of simplicity, below the four light sources 1-4 will be referred to as lamps. The lighting system further comprises a control system, which includes drive units 6-9, each one thereof connected with, and more particularly mounted within, a respective one of the lamps 1-4. The control system further comprises a detector device 10, below also called detector, and a master controller 11, below also called master. In this embodiment the detector 10 and the master 11 are separate physical entities, but alternatively they can be one and the same physical entity as well. The detector device 10 communicates wirelessly with the master controller 11, which in turn communicates wirelessly with the drive units 6-9. Alternatively the communication can be wired if more appropriate in a particular application.

The detector 10 detects the overall light output from the set of lamps 1-4, i.e. a fraction of the light emitted by each lamp impinge on a sensor portion 12 of the detector 10. As can be understood from FIG. 1 typically the amount of the fractions differs, and sometimes the differences are big. For instance in FIG. 1 the detected fraction of light originating from lamp 4, which is farthest away from the detector 10 and additionally is disadvantageously directed relative to the detector 10, is considerably smaller than the fraction of light originating from the closest lamp 1. The same applies to the intensity of the light detected from different lamps 1-4, where the intensity of the light output form the different lamps has an influence as well. For example, FIG. 1 is meant to show that the second lamp 2 from the left has a higher intensity than the other lamps 1, 3, 4.

As described above in conjunction with prior art such differences often lead to either a lack of quality of the detected light causing low quality control of the light output of the set of lamps and low reliability of the received individual information, or an excessive compensation such as designing the lighting system and its control system for a worst case scenario. The differences are dealt with in a more sophisticated way by means of the present method as will now be explained and exemplified in greater detail.

Figure 2A:
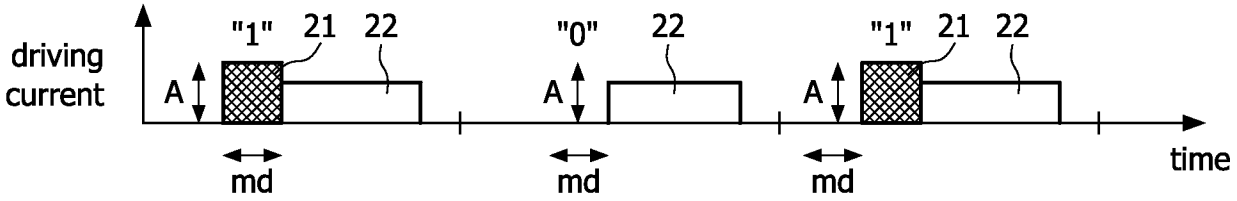
FIGS. 2*a* and 2*b* are schematically illustrated timing diagrams for two kinds of modulation techniques according to different embodiments of the control method of the present invention.

Each lamp 1-4 emits, or generates, a light output signal. In this embodiment each one of the drive units 6-9, as schematically shown in FIG. 2*a*, feeds a drive signal, which consists of a power signal 22 and a modulation signal 21, which modulates the power signal 22, to a respective light emitting element 13-16. The power signal is a PWM signal. The PWM modulation is used for setting the intensity of the light output signal. The power signal 22 is additionally modulated by the modulation signal 21, which is added as a short pulse at the beginning of each power signal pulse. The short pulse represents one bit. The presence of the short pulse represents a logical "1", and the absence thereof represents a logical "0". It is assumed that in average half of the bits of the modulation signal are ones. In order to keep the intensity of the light output signal of each lamp 1-4 non-affected by the added power of the modulation signal the pulse width of the power signal 22 is consequently reduced by half the pulse width of the modulation signal 21. Thereby, for example the light output level or the dimming level, which is the output in percent of the maximum output, of the individual light output signal is kept unchanged. The modulation signal 21 comprises individual information including identification information, which is represented as code in the form of plural consecutive bits of a unique combination of ones and zeros.

The detector 10 is arranged in a position where it is desired to control the light conditions and/or detect the individual information. The detected light contains contributions from all four lamps 1-4, and the detector 10 is able to sort out which contribution comes from which lamp, thanks to the unique individual codes. Further, the detector 10 estimates the intensity of each individual light output signal. Additionally, the detector 10 determines path performance parameters for all light paths 17-20 between the respective lamp 1-4 and the detector 10. More particularly, the detector 10 typically determines the signal-to-noise ratio of the light paths 17-20; the amplitude of the detected part of the individual light output signal that represents the information bit; and a ratio of correctly and incorrectly received data bits, such as a bit error rate. The path performance parameters are regarded as levels of quality for the extraction of the individual information.

The detector 10 transmits all detected and determined data to the master 11, via a first control link C1. The master 11 determines a quality measure by comparing the present levels of quality as received from the detector 10 with desired levels of quality, which are stored in a look-up table held by the master 11. If the comparison reveals that there is a significant difference between a present level of quality and a desired level of quality the master 11 will adjust the modulation signal in order to bring the levels of quality to be determined in a following detection closer to the desired levels of quality. As shown in FIG. 2*a*, the modulation signal can be modified as regards the modulation depth (md), i.e. the pulse width, and the amplitude (A) of each pulse of the modulation signal. An increase of the modulation depth and/or the amplitude of the modulation signal 21 will render an increase also in the level of quality of the extraction of individual information. However the master 11 takes the dimming level into account. If the dimming level is very high or very low, high modulation depths might not be available. The adjustment of the modulation signal is performed by the master 11 transmitting control values for the generation of the modulation signal to the drive unit 6-9 of the lamp 1-4, via a second control link C2. The drive unit 6-9 generates and feeds a corresponding modulation signal 21 to the light emitting element 13-16.

Figure 2B:
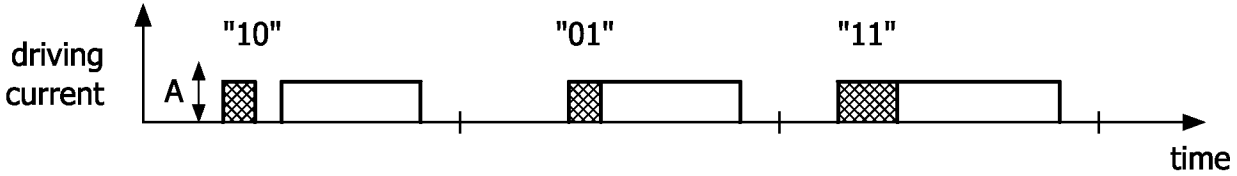

In addition to the mentioned properties of the modulation signal 21, the master 11 decides on the data rate of the modulation signal 21. If the level of quality of the extraction of individual information is high enough, then it will be possible to increase the data rate by transmitting multiple bits within the same duration of the modulation signal pulse. This duration will be referred to as a time slot. Thus, as shown in FIG. 2*b* it may be possible to transmit two bits in each time slot instead of one bit as is the case in FIG. 2*a*.

Having decided on modulation signal adjustments the master 11 then determines whether to adjust the power signal as well or not, in order to maintain or obtain a desired light intensity level at the position of the detector 10. When the master 11 determines the control values for the power signal 22, in addition to a basic intensity requirement it takes into account any adjustments of the modulation signal, which affects the intensity of the light from the lamp in question. Further, the master 11 will consider the color of the light to keep it unchanged. Consequently, at least in this embodiment, the level of the power signal 22 depends on all the conditions described above.

Figure 3:
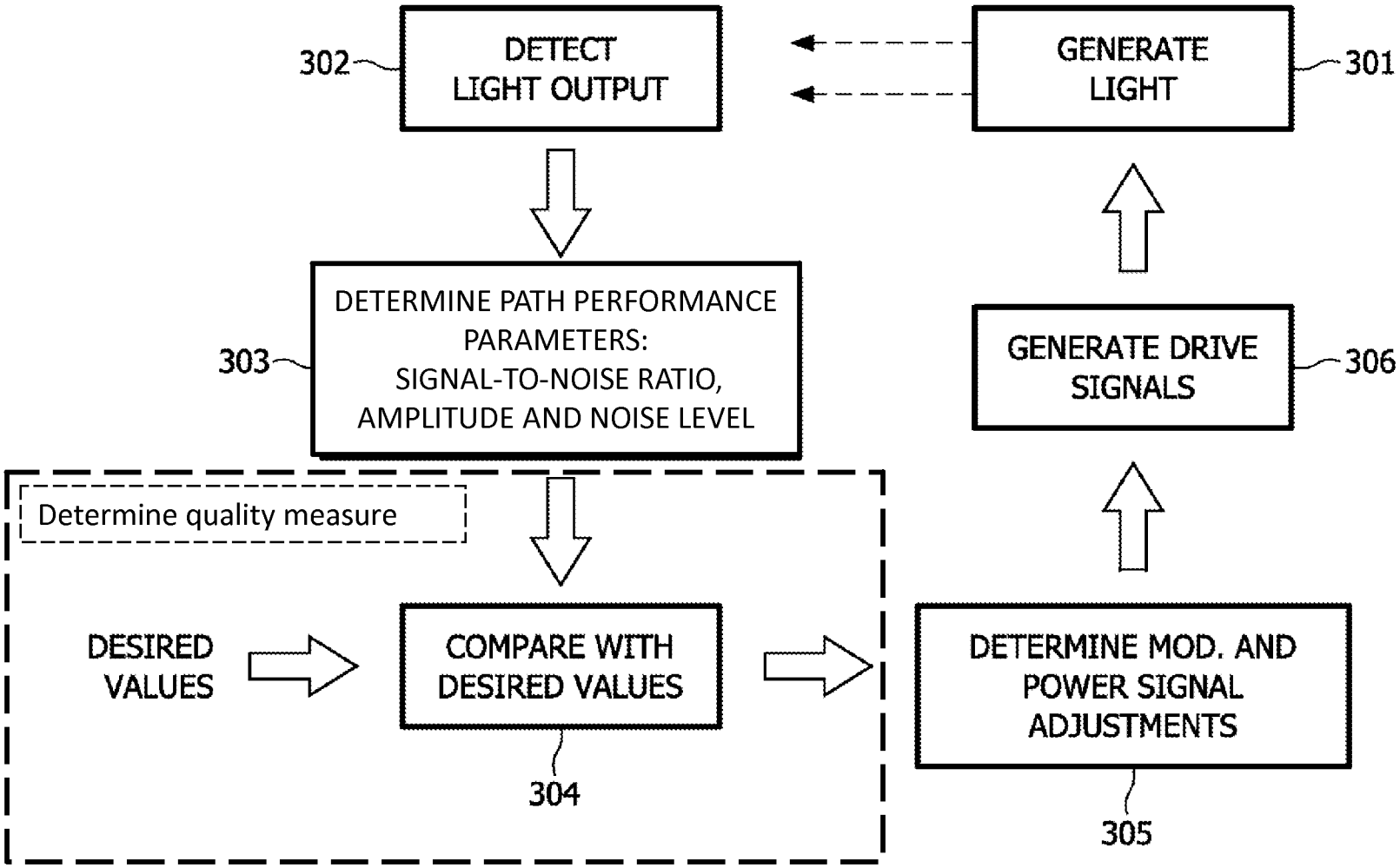
FIG. 3 is a functional diagram of the adaptation process that is performed by means of an embodiment of the method according to the present invention.

Thus, summarily, referring to the functional diagram, or flow chart, of FIG. 3, the flow of steps that are recurrently performed in the present adaptive control are: generating light in the light sources 1-4 by means of the light emitting elements 13-16, see box 301; detecting the light output by means of the detector device 10, in box 302, measuring values of light path performance and light properties and detecting the individual data, and sending the values to the master controller 11, see box 303; determining deviations from desired values, box 304; determining modulation signal and power signal adjustments, and sending them to the drive units 6-9, box 305; generating drive signals comprising power signals and modulation signals and feeding the drive signals to the light emitting elements 13-16, box 306. Then the process continues at box 301.

The desired levels of quality, and light properties, such as intensity or color point, are preset, but it is also possible for a user of the lighting system to change those values by either a direct input to the master controller 11, or an indirect input via the light sources 1-4. In the latter case the new value(s) is/are transmitted from the drive units 6-9 to the master controller 11.

In an alternative, or in addition, to the look-up table mentioned above, the master controller 11 employs a control algorithm. Many different known algorithms are applicable, such as based on Kalman filters, LMS filters or RLS filters.

It should be noted that the control links C1, C2 can be wireless or wired, where the wireless alternative is preferred.

However, as regards the first control link, in case the detector 10 and the master controller 11 are arranged in one and the same physical entity, the link is typically internal of the hardware.

Above, embodiments of the control method and control system according to the present invention as defined in the appended claims have been described. These should be seen as merely non-limiting examples. As understood by a skilled person, many modifications and alternative embodiments are possible within the scope of the invention.

For example, in an alternative embodiment, the determination of data rate is based on more than one estimation of performance parameters, i.e. several consecutive estimations are used in common.

Further, in an alternative embodiment, the modulation signal is implemented by one or more CDMA (Code Division Multiple Access) codes. Then, in order to increase the level of quality of extracting the individual information for a light source having a low level of quality, multiple CDMA codes are assigned to the light source. Alternatively, the length of the CDMA codes can be increased. This can be done adaptively as is done for the other properties of the modulation signal.

In an alternative embodiment of the method the light output signal is detected by means of the detector 10, and a quality measure is determined by solely measuring the background light, which quality measure is then used for adjusting the modulation signal.

In further alternative embodiments only the modulation signal is adjusted and/or the step of remotely detecting the light output signal comprises extracting the individual information from the light output signal, and the step of determining at least one quality measure comprises determining a quality measure of said extraction of individual information.

Even further combinations of parameters used for determining the quality measure and choices of adjusting only the modulation signal or the power signal as well are possible within the scope of this invention as defined by the appended claims, as is understood by a person skilled in the art.

The invention claimed is:

1. A method for controlling light emitted by a set of light sources comprising:

at least one light source, wherein said emitted light is modulated with a modulation signal, said modulation signal carrying information related to the set of light sources, the method for controlling the light includes recurrently:

remotely detecting by a detector the light emitted by said set of light sources;

extracting, from the modulation signal, the information carried by the modulation signal;

determining, based on the extracted information, at least one performance parameter of a light path extending between the set of light sources and a position where the remote detection takes place, by determining at least one of signal-to-noise ratio of the light path and signal amplitude of the modulation signal;

using said at least one performance parameter for determining at least one quality measure by a controller; and adjusting the modulation signal on basis of said at least one quality measure by adjusting at least one of modulation depth, frequency, and intensity of the modulation signal, wherein the adjusting the modulation signal considers a dimming level of the set of light sources and maintains the dimming level when adjusting the at least one of modulation depth, frequency, and intensity.

2. The method of claim 1, further including providing a power signal to drive the at least one light source, said remotely detecting the emitted light further includes estimating of at least one light property of said emitted light, recurrently adjusting said power signal on the basis of the estimating of at least one light property.

3. The method of claim 2, wherein said step of adjusting the power signal is further based on said adjustment of the modulation signal.

4. A method for controlling light emitted by a plurality of light sources, comprising:

driving the plurality of light sources with a drive signal including a power signal and a modulation signal, wherein the modulation signal modulates light output from the plurality of light sources to carry individual information about the plurality of light sources;

detecting, with a detector device, the light emitted by the plurality of light sources;

extracting the individual information about the plurality of light sources from the emitted light;

determining at least one quality measure of said detected light based on the extracted individual information, wherein the at least one quality measure includes an estimation of at least one performance parameter for a plurality of light paths between the plurality of light sources and the detector device; and adjusting the modulation signal on the basis of the at least one quality measure, wherein the adjusting the modulation signal considers and maintains a dimming level of the plurality of light sources.

5. The method of claim 4, further comprising adjusting the power signal based on adjustments made to the modulation signal.

6. A method for controlling light emitted by a set of light sources comprising:

modulating light emitted by at least one light source of the set of light sources to carry information related to the at least one light source;

detecting, by a detector device that is separate from the at least one light source, the light emitted by the at least one light source;

extracting the information carried by the detected light;

determining, based on the extracted information, at least one performance parameter of a light path extending between the set of light sources and a position where the detection takes place, by determining at least one of signal-to-noise ratio of the light path and signal amplitude of the extracted information;

using said at least one performance parameter for determining at least one quality measure by a controller; and altering modulation of the light emitted by the at least one light source on the basis of said at least one quality measure by adjusting at least one of modulation depth, frequency, and intensity of a modulation signal, wherein the altering the modulation signal considers a dimming level of the at least one light source and maintains the dimming level when adjusting the at least one of modulation depth, frequency, and intensity.

7. The method of claim 6, further comprising adjusting a data rate of the modulation based upon the quality measure.

8. The method of claim 6, further comprising adjusting a power signal used to drive one or more light sources of the set of light sources based on adjustments made to the modulation signal.

9. The method of claim 2, wherein the at least one light source is driven by a drive signal to form said emitted light, wherein the drive signal includes both: a) the modulation signal to include said information in said emitted light, and b) a power signal that sets the intensity of the emitted light.

10. The method of claim 4, wherein said modulation signal carries said information and wherein said power signal sets the intensity of the emitted light.

11. The method of claim 6, wherein said modulation signal carries said information, wherein the at least one light source is driven by a drive signal to form said emitted light, and wherein the drive signal includes both: a) the modulation signal to include said information in said emitted light, and b) a power signal that sets the intensity of the emitted light.

* * * * *